US007205477B1

(12) United States Patent
Gilliland et al.

(10) Patent No.: US 7,205,477 B1
(45) Date of Patent: Apr. 17, 2007

(54) SURFACE MOUNTED COMPONENTS USING STRIP LINE CONDUCTORS FOR SURFACE WIRING

(75) Inventors: Don A. Gilliland, Rochester, MN (US); Dennis J. Wurth, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/456,156

(22) Filed: Jul. 7, 2006

(51) Int. Cl.
*H01R 9/05* (2006.01)

(52) U.S. Cl. ..... 174/74 R

(58) Field of Classification Search ..... 174/74 R, 174/88 R; 439/651
See application file for complete search history.

(56) References Cited

U.S. PATENT DOCUMENTS

| | | | | |
|---|---|---|---|---|
| 2,977,562 | A * | 3/1961 | Benson | 439/58 |
| 3,659,247 | A * | 4/1972 | Chaney et al. | 439/32 |
| 3,699,500 | A * | 10/1972 | Borzoni et al. | 439/357 |
| 5,372,515 | A * | 12/1994 | Miller et al. | 439/138 |
| 2004/0253876 | A1 * | 12/2004 | Kim | 439/651 |

* cited by examiner

*Primary Examiner*—Chau N. Nguyen
(74) *Attorney, Agent, or Firm*—Cantor Colburn LLP

(57) ABSTRACT

A wiring module includes a wire element selected from the group consisting of coaxial cable, a twisted pair of conductors, and a strip line conductor, a dielectric enclosure surrounding the wire element, a pin end having one or more pins in electrical communication with an end of the wire element; and, a receptacle end having one or more pin receptacles, disposed within one or more slots of the receptacle end, in electrical communication with another end of the wire element.

6 Claims, 4 Drawing Sheets

SURFACE MOUNTED COMPONENTS USING STRIP LINE CONDUCTORS FOR SURFACE WIRING

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates to a wiring arrangement for printed circuit boards, and particularly to a wiring arrangement for surface mounted components utilizing twisted and non-twisted conductors.

2. Description of Background

Printed circuit boards are widely used in various electronic/electric devices such as communications equipment, control devices, household appliances, radios, televisions, washing machines, audio equipment, microwave ovens, etc. Each of these devices has enjoyed success for decades but in an ever more demanding world, requirements for their functionality continue to expand. With such expansion of capability comes the demand for higher density at the circuit board level. This can come due to size constraints or simply functional demands. As the demand for smaller, more powerful electronic systems increase, system manufacturers are tasked to find a way to increase system performance while decreasing the size of the electronic components within the electronic system.

Surface mount technology is a widely used method for constructing electronics circuits in which the components are mounted directly onto the surface of the printed circuit boards. Surface mount components are generally smaller than "through hole" mounted components and further allow for placement on both sides of the printed circuit board. Additionally, surface mounted components promote the use of automation during printed circuit board construction and therefore reduce labor costs and greatly increase production rates.

The physical dimensions of printed circuit board traces become significant relative to the wavelength of the signal at high frequencies. At these high frequencies, controlled impedance transmission lines are used to provide a path for signals from one portion of the printed circuit board to another potion of the printed circuit board. As circuit density and clock speeds increase in electronic devices, so does the need to interconnect electronic components with impedance controlled transmission lines. A current limitation in transmission lines arises when a twisted pair configuration is utilized to control the magnetic field and connect one portion of the printed circuit board to another portion of the printed circuit board. Properly forming the very precise uniform twists that make up the twisted pair is difficult to perform within the confines of printed circuit board layers having nets and vias. Additionally, many production level printed circuit boards have test ports that contain a transmission line stub connection. Stub connections are electrically undesirable as they provide a discontinuity of impedance. If the impedances are not uniform, then reflections are created that decrease signal integrity and increase electromagnetic interference (EMI). Currently, to avoid these problems, the circuit boards are either turned to remove the top side wiring or the wiring is left on the board which creates a possible reflection and radiation problem due to an antenna effect as noted above. Furthermore, removing top side wiring, or performing any rework operation on printed circuit boards, generally requires labor intensive practices that do not allow for the use of automated equipment.

Accordingly, there is a need for an improved wiring scheme that allows for ease of installation, compatibility with automated equipment, and allows for the formation of precise twisted pairs while minimizing reflections and EMI within the circuit.

SUMMARY OF THE INVENTION

The shortcomings of the prior art are overcome and additional advantages are provided through the provision of a wiring module. The wiring module includes a wire element selected from the group consisting of coaxial cable, a twisted pair of conductors, and a strip line conductor, a dielectric enclosure surrounding the wire element, a pin end having one or more pins in electrical communication with an end of the wire element; and, a receptacle end having one or more pin receptacles, disposed within one or more slots of the receptacle end, in electrical communication with another end of the wire element.

The shortcomings of the prior art are also overcome and additional advantages are provided through the provision of a wiring circuit. The wiring circuit includes a first wiring module having a first wire element selected from the group consisting of coaxial cable, a twisted pair of conductors, a strip line conductor, a first enclosure surrounding the first wire element, and a pin end having one or more pins in electrical communication with an end of the first wire element; and, a second wiring module having a second wire element selected from the group consisting of coaxial cable, a twisted pair of conductors, and a strip line conductor, a second enclosure surrounding the second wire element, and a receptacle end having one or more pin receptacles, disposed within one or more slots of the receptacle end, in electrical communication with an end of the second wire element; wherein the one or more pins of the first wiring module are disposed within the one or more slots of the second wiring module creating an electrical connection between the first module and the second module.

Additional features and advantages are realized through the techniques of the present invention. Other embodiments and aspects of the invention are described in detail herein and are considered a part of the claimed invention. For a better understanding of the invention with advantages and features, refer to the description and to the drawings.

TECHNICAL EFFECTS

As a result of the summarized invention, technically we have achieved an improved surface wiring configuration for printed circuit boards.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
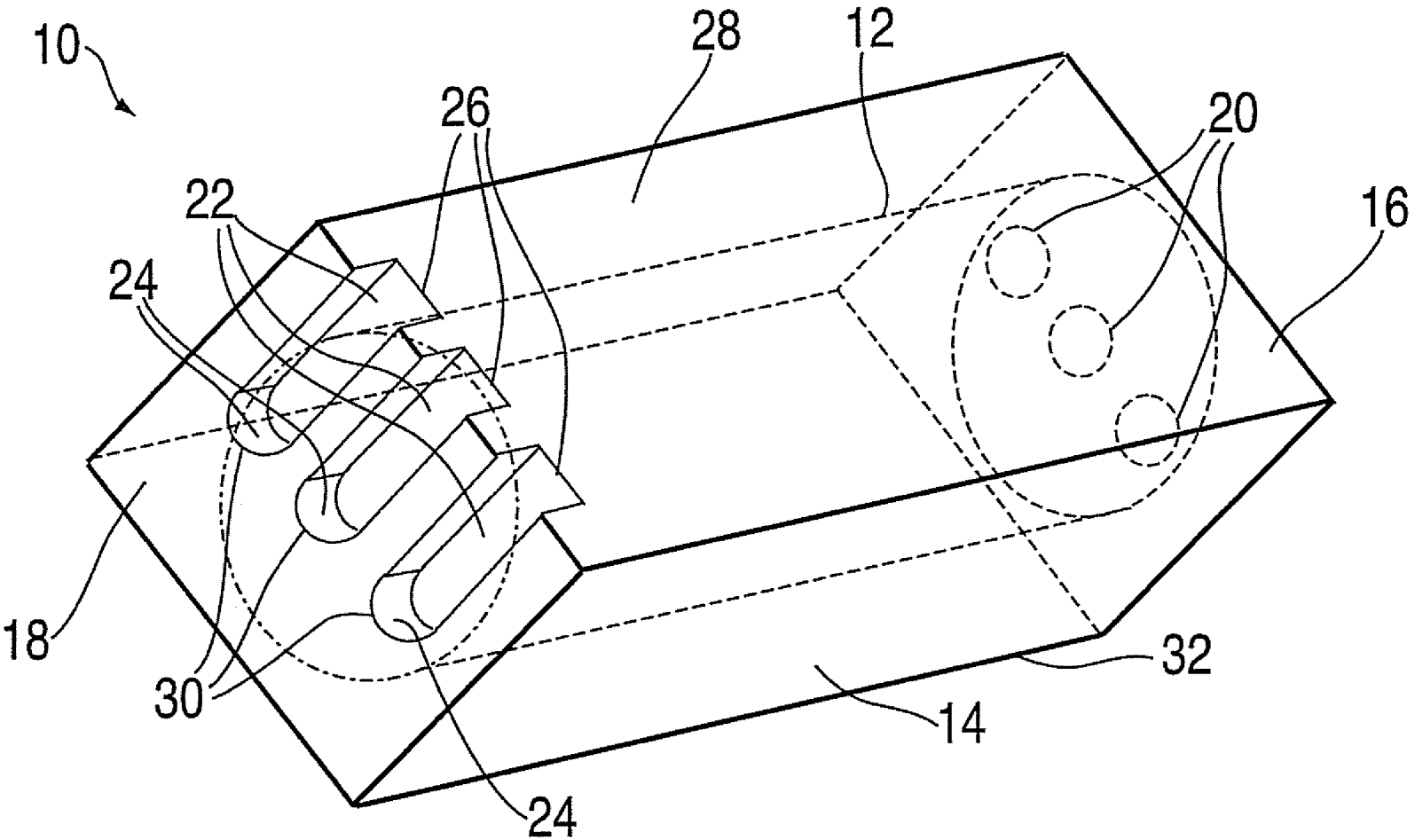
FIG. 1 illustrates one example of a perspective view of a wiring module.

Turning now to the drawings in greater detail, it will be seen that in FIG. 1 there is a perspective view of an exemplary wiring module 10 that, for example, can be used for surface wiring on a printed circuit board. The wiring module 10 includes a wire element 12 disposed within an enclosure 14 having a pin end 16 and a receptacle end 18. The pin end 16 comprises one or more pins 20 which are electrically connected to an end of the wire element 12 and the receptacle end 18 comprises one or more slots 22, each having a pin receptacle 24 connected to the other end of the wire element 12. The enclosure 14 provides a support structure for the pin end 16, receptacle end 18, and the wire element 12 as well as serving as dielectric for the wiring module 10.

Figure 2:
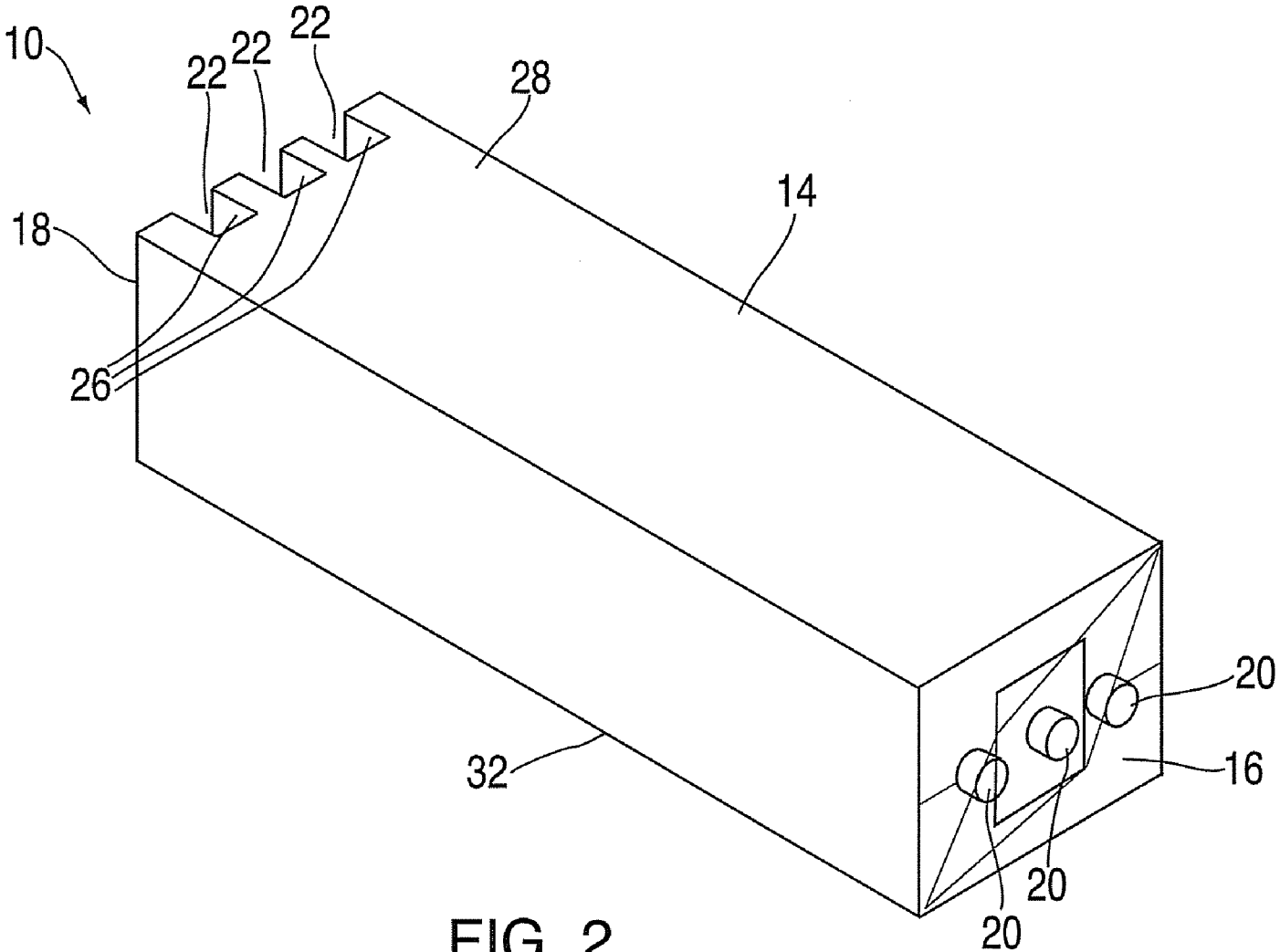
FIG. 2 illustrates another perspective view of the wiring module of FIG. 1.
Figure 3:
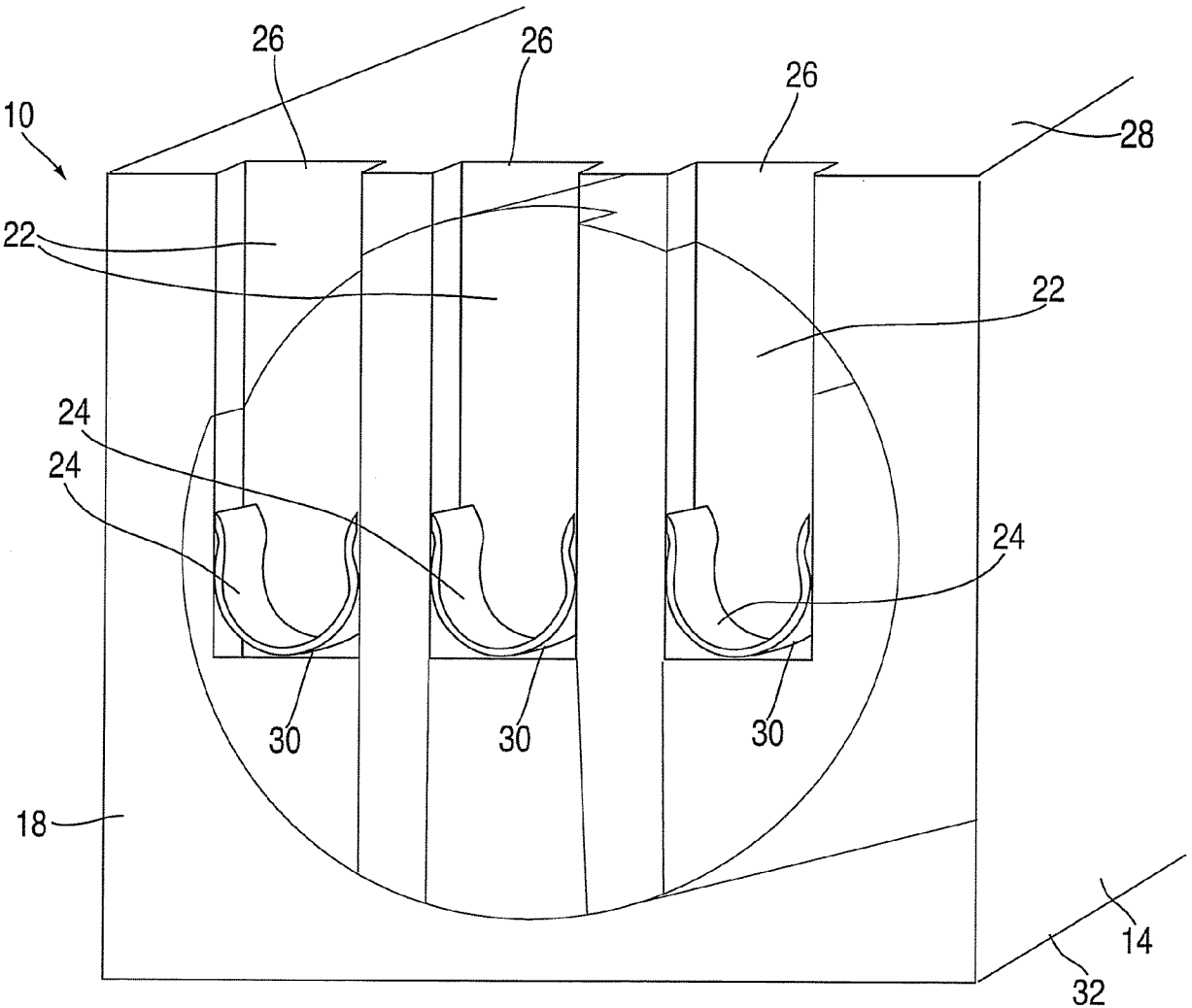
FIG. 3 illustrates an enlarged view of the wiring module of FIG. 1.

The pin end 16 and the receptacle end 18 have complementary features that allow for the mating and electronic connection of one wiring module 10 to another wiring module 10. As further illustrated in FIG. 2, the one or more pins 20 project from the pin end 16 at a sufficient distance to allow for an electrical connection. It will be appreciated that although the figures illustrate a cylindrically shaped pin, other shapes capable of forming an electrical connection with a mating component are envisioned. As further illustrated in FIG. 3, the one or more slots 22 have an open end 26, which intersects a first face 28 of the wiring module 10, and a closed end 30, which includes the pin receptacle 24. The pin receptacle 24 may be of any shape capable of providing and maintaining an electrical connection with the mating pin 20 such as a snap in clip or press fit receptacle.

The wiring module 10 is capable of containing several types of wire elements 12 including coaxial cable, twisted pairs, and strip line configurations for example. Additionally, the enclosure 14 has suitable dimensions to surround the varying types of wire elements 12 and may be a homogeneous or non-homogeneous dielectric. Nets immersed in the dielectric ensure uniform electric fields within the wiring module 10 and minimize differential to common mode conversion. Further the enclosure 14 may also be a plastic pre-form or ferrite structure, which also provides for common mode filtering. The disclosed enclosure 14 may be fabricated by conventional manufacturing methods, such as injection molding, for example.

Figure 4:
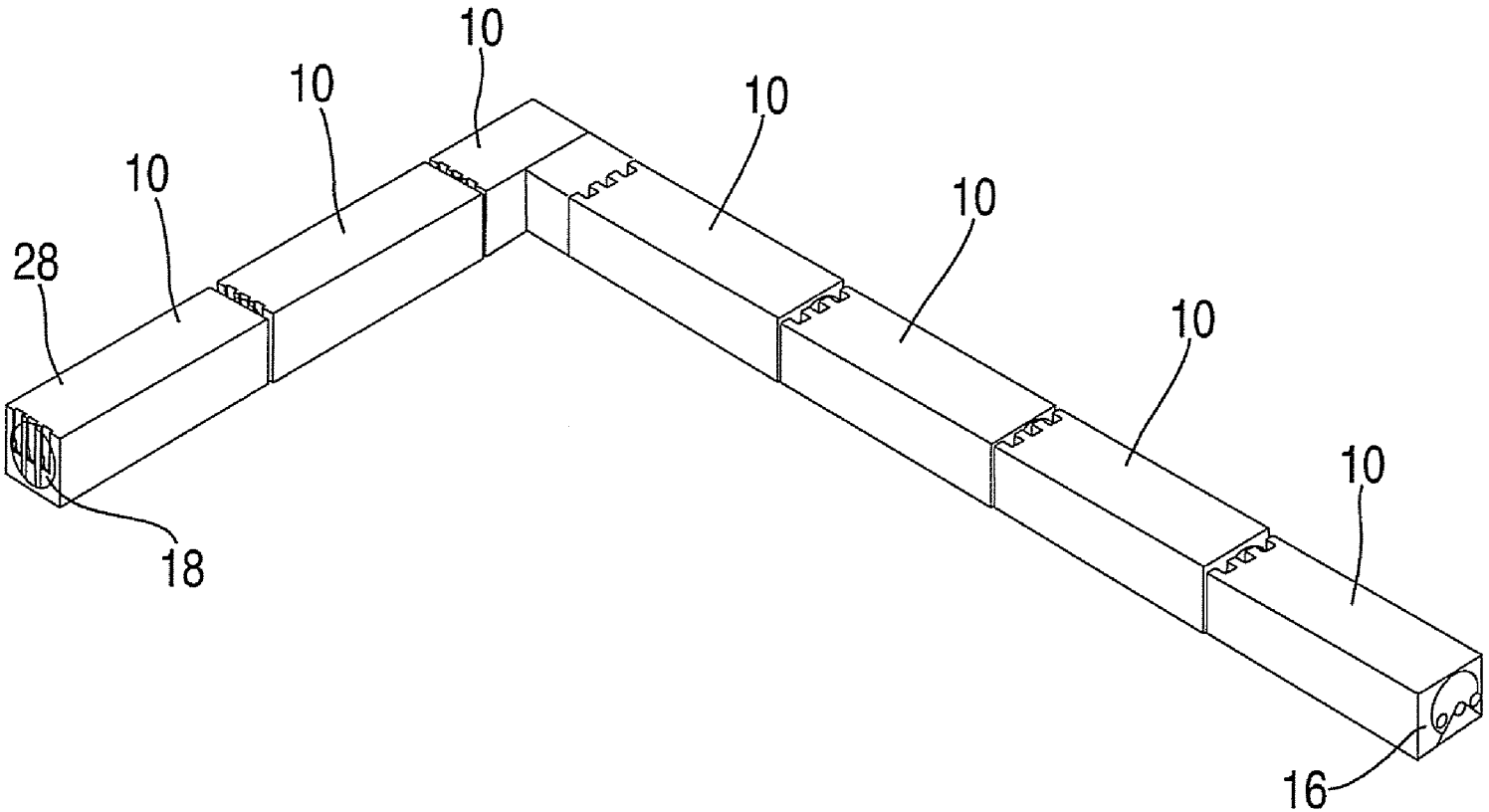
FIG. 4 illustrates one example of a circuit comprising wire modules.

FIG. 4 illustrates several wiring modules 10 interconnected to form a complete removable circuit. The disclosed wiring module 10 provides a modular, controlled impedance, wiring scheme that can be built on a printed wiring board using standard "pick and place" machinery. During processing of the printed wiring board, the pick and place equipment attaches (e.g., by, for example, adhesive on a second face 32 of each wiring module 10) the wiring module 10 to a printed circuit board. Another wiring module 10 is then attached to the printed circuit board by the pick and place equipment such that the one or more pins 20 of one wiring module 10 are electrically connected to the one or more receptacles of the another wiring module 10. Additional wiring modules 10 are then added by the pick and place equipment to complete a wiring path from a first area on the printed circuit board to a second area on the printed circuit board. The receptacle end 18 of the wiring module 10 allows the pin end 16 of the wiring module 10 to slide into position with the pick and place machine to make connections. As in any connection, this produces a discontinuity but different lengths of the part would place the discontinuities further and further apart. The wiring module 10 provides for a particular transmission line impedance (e.g., 50 ohms) using such techniques as coaxial configuration, twisted pair configuration, strip line configuration, etc, of the electrical path between the first coupling element and the second coupling element.

The wiring modules 10 provide for the advantage of performing quick wiring and rework, for test port applications for example, on one side of a printed circuit board without having to turn the board. The placement of the wiring modules 10 may be performed by "pick and place" machinery, which provides an automated placement method for the wiring modules 10 on the printed circuit board as well as the ability to perform high speed interconnections between the electrical contacts. In prototyping and test applications, the wiring modules 10 may be placed and interconnected on the printed circuit board and for permanent connection the wiring modules 10 may be reflowed. Additionally, the beginning and termination points on the wiring module 10 "string" circuit may be connected to board copper using conventional connection methods. An additional advantage of the wiring modules 10 includes the ability to create very precise twisted pairs, which are difficult to perform within the confines of conventional circuit board layers with nets and vias.

Although the figures illustrate wiring modules 10 having three pins 20 and three pin receptacles 24, for a ground/signal reference pin 20 or receptacle between two differential signal pins 20 or receptacles for example, it is to be understood that other configurations having more or less pins and receptacles are envisioned, such as for example a two pin and receptacle wiring module 10 for a straight pair wire element configuration. Additionally a ground plane only or partial shield may be utilized with the wiring module 10 based on the particular printed circuit board application. Further, single ended modules, for individual circuits, or auxiliary module connectors, such as angle, initiation and termination connectors for board connection, may be implemented as well.

The capabilities of the present invention can be implemented in software, firmware, hardware or some combination thereof.

As one example, one or more aspects of the present invention can be included in an article of manufacture (e.g., one or more computer products) The article of manufacture can be included as a part of a computer system or sold separately.

While the preferred embodiment to the invention has been described, it will be understood that those skilled in the art, both now and in the future, may male various improvements and enhancements which fall within the scope of the claims which follow. These claims should be construed to maintain the proper protection for the invention first described.

What is claimed is:

1. A wiring module comprising:

a wire element being a strip line conductor;

a dielectric enclosure surrounding the wire element having a first face substantially parallel to a length of the wire element;

a pin end having one or more pins in electrical communication with an end of the wire element; and, a receptacle end having one or more pin receptacles, disposed within one or more slots of the receptacle end, in electrical communication with another end of the wire element, wherein the one or more slots each have an open end intersecting the first face of the enclosure.

2. The wiring module of claim 1 wherein the pin receptacle is a snap in clip.

3. A wiring circuit comprising:

a first wiring module having a first wire element being a strip line conductor, a first enclosure surrounding the first wire element, and a pin end having one or more pins in electrical communication with an end of the first wire element; and a second wiring module having a second wire element being a strip line conductor, a second enclosure surrounding the second wire element having a first face substantially parallel to a length of the second wire element, and a receptacle end having one or more pin receptacles, disposed within one or more slots of the receptacle end, the one or more slots each having an open end intersecting the first face of the enclosure, the one or more pin receptacles being in electrical communication with an end of the second wire element;

wherein the one or more pins of the first wiring module are disposed within the one or more slots of the second wiring module creating an electrical connection between the first module and the second module.

4. The wiring circuit of claim 3 wherein the first wiring module further comprises a receptacle end having one or more pin receptacles, disposed within one or more slots of the receptacle end, the one or more slots each having an open end intersecting a first face of the enclosure the one or more pin receptacles being in electrical communication with another end of the first wire element.

5. The wiring circuit of claim 3 wherein the second wiring module further comprises a pin end having one or more pins in electrical communication with another end of the second wire element.

6. The wiring circuit of claim 3 wherein the one or more pins are in electrical communication with the one or more receptacles.

* * * * *